United States Patent [19]

Roberts

[11] 3,938,226

[45] Feb. 17, 1976

[54] APPARATUS FOR CRIMPING YARN

[75] Inventor: John S. Roberts, Ellicott, Md.

[73] Assignee: Kling-Tecs, Inc., Columbia, Md.

[22] Filed: Mar. 13, 1974

[21] Appl. No.: 446,175

[52] U.S. Cl. ..... 28/1.7
[51] Int. Cl.[2] ..... D02G 1/12
[58] Field of Search ..... 28/1.6, 1.7

[56] References Cited

UNITED STATES PATENTS

| | | | |
|---|---|---|---|
| 3,587,145 | 6/1971 | McKinney et al. | 28/1.7 |
| 3,733,659 | 5/1973 | Smith | 28/1.7 |

*Primary Examiner*—Louis K. Rimrodt
*Attorney, Agent, or Firm*—Nolte and Nolte

[57] ABSTRACT

Apparatus and method for stuffer box crimping yarn is disclosed in which continuous filament drawn yarn having a thermoplastic component and varying in denier along its length is treated in the same crimping area and where that portion of the yarn of higher denier is texturized to a lesser extent than that portion of the yarn of lower denier. The apparatus for carrying out the method provides a crimp site and a very short plug guiding area which establishes the lateral width of the plug. A pair of pressure shoes are oppositely disposed on either side of the plug of crimped yarn as it leaves the guiding area. The shoes are spaced apart at a slightly greater distance than the width of the guiding area to provide voids along the plug sides thereby reducing if not eliminating back pressure in the plug due to lateral plug contact above the guiding area and are pivoted adjacent the guiding area, and apply a uniform pressure on opposite sides of the plug downstream of the guiding area where they converge against the plug. Means for relaxing the plug of yarn fore and aft of its axis are provided intermediate the crimping site and the downstream ends of the pressure shoes. A gathering area downstream of the pressure ends of the shoes is designed to have little or no effect upon the yarn entering and leaving it, and in this respect, it provides further means for yarn plug relaxation.

8 Claims, 8 Drawing Figures

APPARATUS FOR CRIMPING YARN

HISTORY OF THE INVENTION

Previous attempts to produce uniform crimp in yarn having a thermoplastic component by the stuffing box method have evolved from the concept of creating a relatively uniform back pressure in the "crimping chamber" and to this end prior art apparatus have provided relatively long crimper boxes providing frictional back pressure along the sides thereof due to build up of a relatively long plug of yarn.

Other prior art apparatus have provided back pressure elements in and/or at the end of a crimping chamber and which, together with plug-chamber friction, maintain a relatively constant back pressure in the plug of yarn.

It is theorized, however, that the mass of the yarn plug affects the yarn end as it enters the crimping site, and it constantly changes throughout such prior art crimping operations, resulting in undesirable variations (those which vary directly with yarn denier) in yarn crimp level along the length of the yarn, including of course such variations along the lengths of yarn ends taken off different packages, as discussed below. This is, it is thought, because the prior art methods do not take into consideration the fact that even the best undrawn yarn stock may vary, within each yarn package and from package to package, in denier along its length and in draw-texturing machines in which yarn is drawn and immediately crimped on the run, additional variations in denier along the length of the yarn due to drawing operations may aggravate the problem and cannot be selectively eliminated.

THE INVENTION

The present invention is based upon the theory which contemplates maintaining relatively constant the mass of the plug of crimped yarn in the crimping area and immediately downstream thereof, so that the characteristics of the trailing end of the plug of yarn at the point of crimp impact remains the same to thereby crimp the yarn to a higher and lesser degree as its denier decreases and increases, respectively.

In the present preferred embodiment of the invention, it is concluded that the yarn is crimped immediately upon impact with the trailing end of the plug of yarn in the crimping head. A very short plug forming and guiding area, comprised of a pair of laterally opposed walls, is provided immediately following the crimp site to extablish the lateral width of the plug. It has been found that once the lateral width of the plug is established by the width of the guiding area, the integrity of the plug width can be held constant without the need for side wall contact by the provision of pressure on the plug downstream of the guiding area. This pressure is provided by a pair of laterally disposed shoes which in the embodiment to be described are at least twice the length of the crimping and guiding area. These pressure shoes are pivoted at their upstream ends adjacent the crimping-guiding area, such that their inner surfaces at their pivotal supports are slightly farther apart than are the walls of the guiding area, thus providing voids along the plug sides to reduce, if not eliminate lateral plug-wall back pressure above the guiding area, such that the downstream portions of the shoes may apply a uniform pressure to the opposite sides of the plug of yarn only downstream of the guiding area. This construction provides a mechanism which together with the plug of yarn, it is believed, is highly sensitive to changes in the mass of the plug resulting from denier change along the length of the yarn as it is fed to the crimping site. The plug is permitted to travel past the ends of the shoes which are at uniform pressure upon the sides of the plug at, it is believed, varying speeds of travel which compensate for denier changes to retain the mass of the plug in the crimping, guiding and shoe or sensing areas relatively constant without any lateral plug-wall friction except in the short guiding area.

As noted, it has been found that the integrity of the plug, across the width thereof, is relatively stable throughout its length from the trailing end or point of crimp to the pressure ends of the shoes, that is, in the planes normal to the axis of the crimper feed rolls, but that this does not necessarily hold true as concerns the fore and aft dimension of the plug. Thus, the invention provides for slight fore and aft plug relaxation as it travels through the sensing zone so that any pressures which the plug exerts on the fore and aft walls and vice versa will have minimal effect in planes normal to the width of the plug.

Provision is also made for gathering the yarn as it leaves the sensing area and in such a way that the plug is relatively unaffected by side wall or back pressure. In this respect, the sides of the gathering chamber in the preferred embodiment diverge upwardingly in the fore-aft direction so that relaxation of the plug in that direction is not sudden.

The invention will be better understood with reference to the following description taken in conjunction with the drawings, in which.

Figure 2:
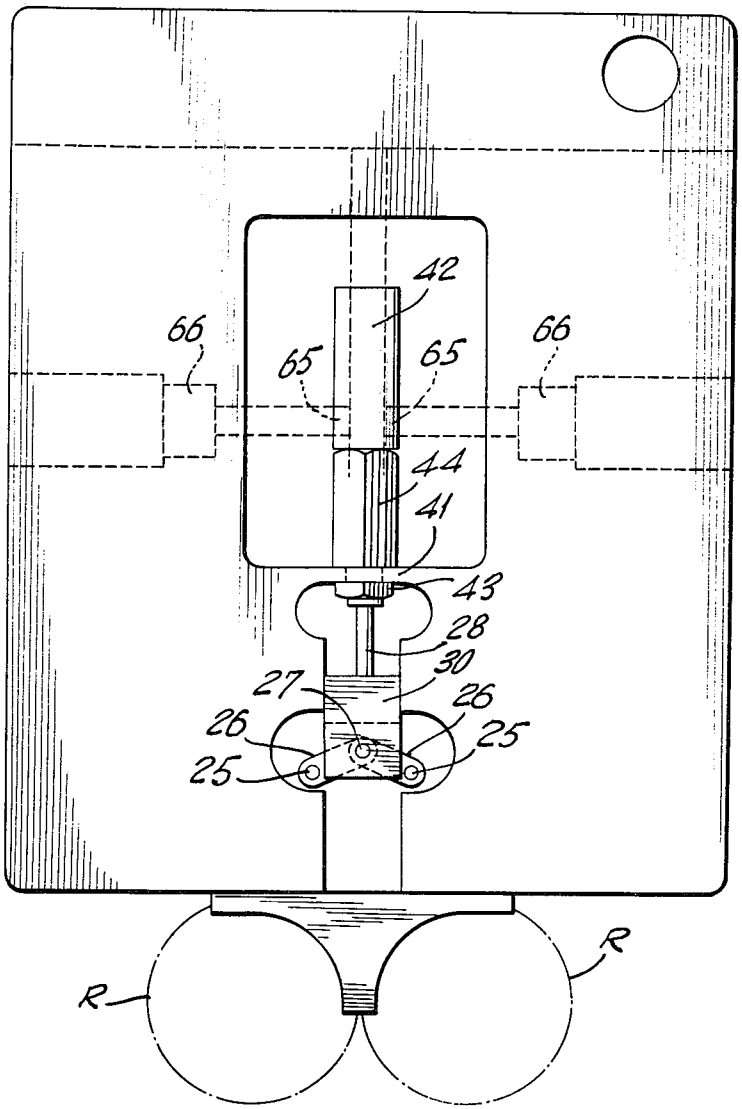
FIG. 2 is a rear elevational view of the crimping head of FIG. 1.
Figure 1:
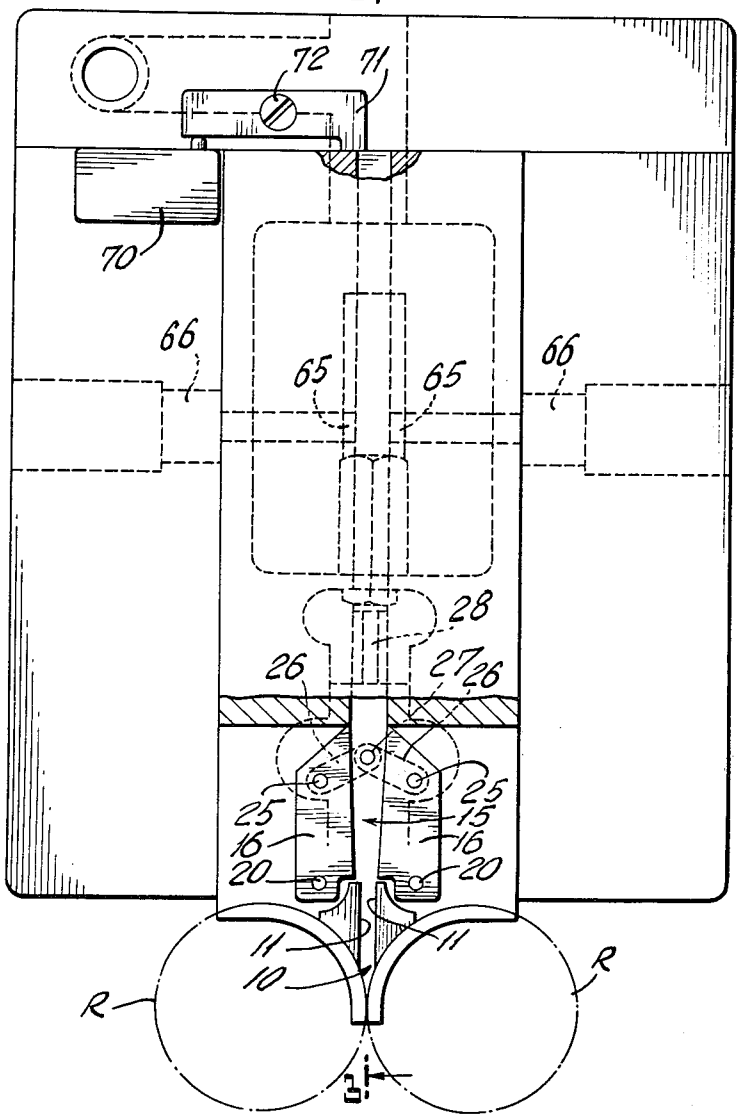
FIG. 1 is a front elevational view, partially broken away, of a crimping head of this invention.

The figures disclose crimping apparatus which generally provides a pair of feed rolls R which feed at least a single end of yarn (not shown in FIGS. 1–6) to a crimping site 10 which the invention contemplates as being immediately past the nip of feed rolls R. The crimp site is followed by a plug guiding area 11 of short length, generally square in cross section and defined by side walls 11 and the lower portions of front and rear plates 12 and 13 (see FIG. 3). The guide area is followed by the sensing area 15, the front and rear walls of which are defined by stuffer box cover 12 and stuffer box back plate 13 which are indented as at 12' and 13' to permit expansion of the plug of yarn in the fore and aft direction as it travels through the plug sensing area 15.

Pressure shoes 16 are pivoted at their lower ends adjacent the crimping area at the upper portion of the guiding area 11 at pivot connections 20 which are journaled in back plate 13 and which may be relatively immovable with respect thereto. The upper ends of the shoes 16 are pivotally connected as at 25 to links 26 which in turn are pivotally connected as at 27 to piston rod 28 via vertically sliding block 30 to which the end of the piston rod 28 is threadedly engaged as at 31.

Slide block 30 is retained in its sliding path by lateral walls 35 and the rearward face of U-shaped upper back plate 40 which also provides apertured platform 41 supporting air pressure cylinder 42 retained in its supported position via nuts 43 and 44 juxtaposed against upper and lower surface of the platform 41 and threadedly retaining rod guide 45.

Figure 5:
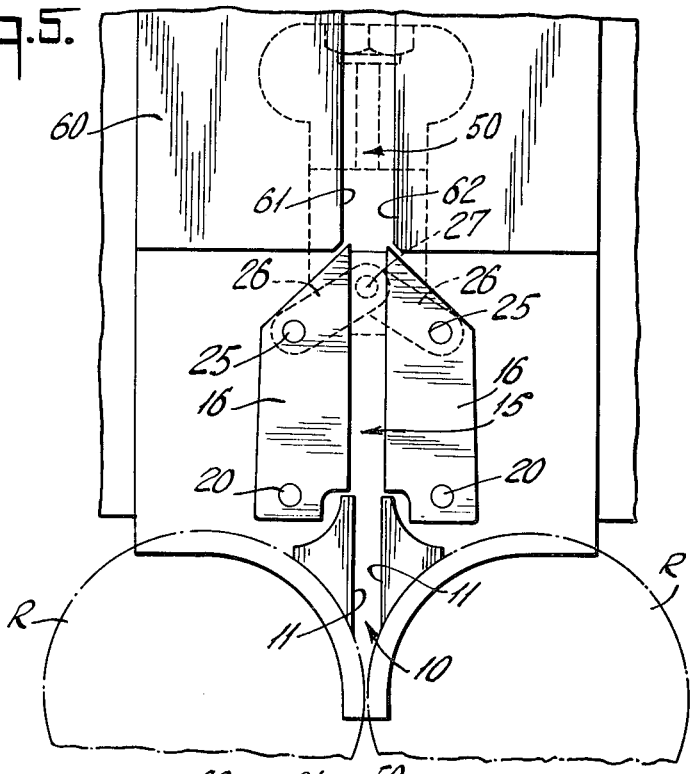
FIG. 5 is an enlarged front elevational view of the crimping and sensing zones of the crimper head of the previous figures with the front plate removed and showing the pressure shoes in a position between open and closed.
Figure 6:
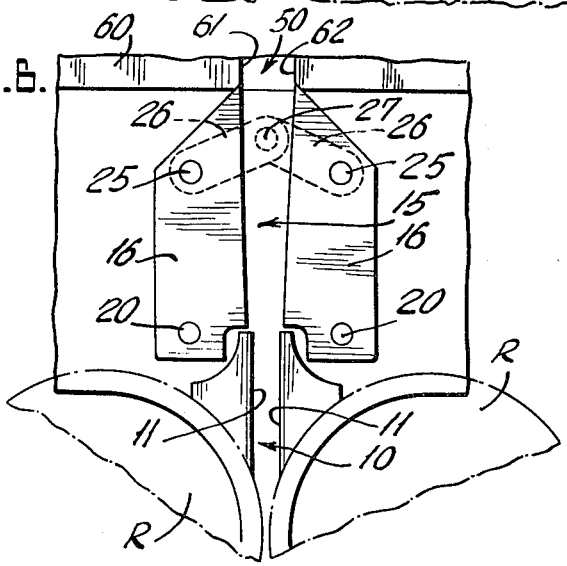
FIG. 6 is a view similar to that of FIG. 5 showing the pressure shoes in the fully open position.

Pressure from cylinder 42 is supplied by conventional means, not shown, and in the embodiment shown acts through the piston, not shown, through rod 28 and links 26 to pivot the upper ends of shoes 16 toward one another against the plug of yarn downstream from the crimping site and guiding area just before it enters the gathering area 50. An intermediate position of the shoes, between "open" and "closed", is shown in FIG. 5, while the open or threading up position is shown in FIG. 6. Diagramatic views FIGS. 7 and 8, as will be discussed, show the shoes in their operative position, albeit exaggerated. Thus, the inner surfaces of the shoes 16 are spaced outwardly of the walls 11 of the guiding area except when in the operative position at which time only the tips of the shoes contact the plug sides.

Figure 3:
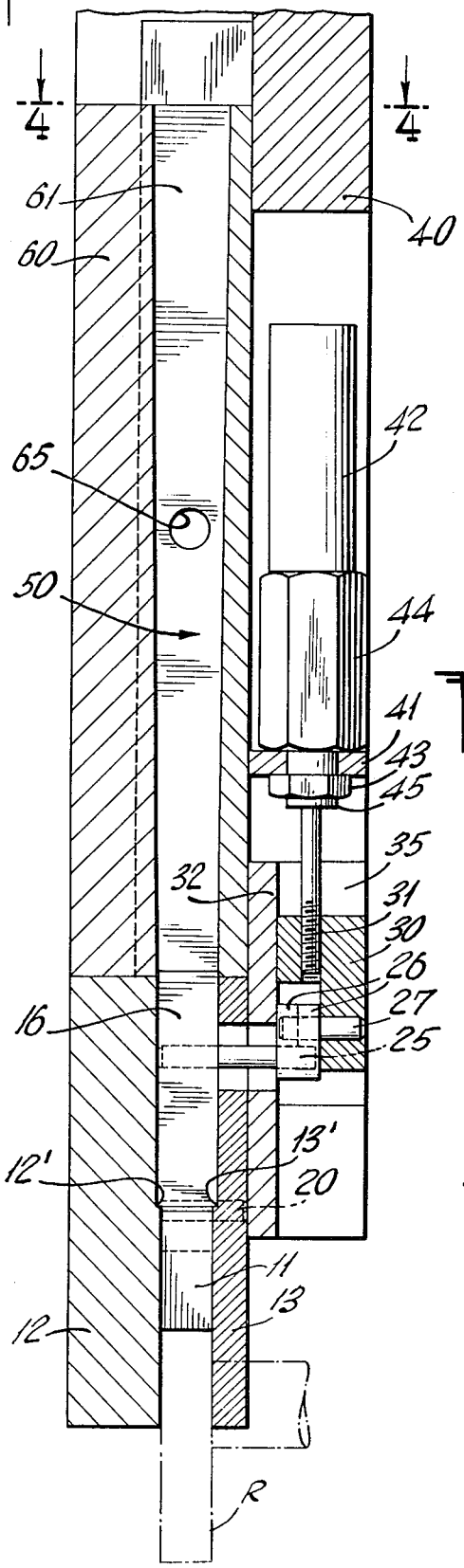
FIG. 3 is a sectional view taken along line 3—3 of FIGS. 1 and 4.
Figure 4:
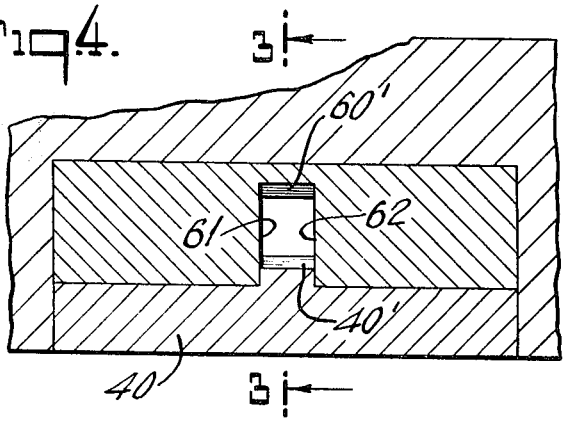
FIG. 4 is a sectional view taken along 4—4 of FIG. 3.

After the plug passes the upper ends of the shoes it is received in gathering area 50, which in this instance is designed to have little or no effect upon the yarn. In this last respect, back plate 40 and front plate 60 provide upwardly diverging rearward and forward walls 40' and 60' as best seen in FIGS. 3 and 4. There is little or no side-to-side wall-plug friction in the gathering zone 50 as side walls 61, 62 thereof formed in back plate 40 are spaced apart a greater distance than walls 11 of the guiding area which have coacted with the plug of yarn to determine the lateral width of the plug which, as has been noted, tends to remain constant. However, provision is made for some lateral expansion which might occur in the sensing area in the voids between the plug sides and the inner surfaces of the shoes.

Intermediate the ends of gathering zone 50 oppositely facing openings 65 may be provided for sensing the leading end of the yarn plug via, for instance, photo cells, not shown, which may be mounted in seats 66 machined in the sides of back plate 40 and which may be operatively associated via circuitry to vary the speed of yarn take-up mechanisms as has been described in the prior art. Thus, the crimping head described may be fitted to existing machinery which provides variable yarn take-up controlled by such means as photo cells. Alternatively or in conjunction with such means, switch 70, operated by spade 71 pivotably supported at 72 may be used to shut off take-up mechanisms in the event downstream controls fail, or may itself be used to vary take-up speed, as the leading end of the plug contacts and lifts the end of spade 71 overlying the gathering area 50.

As noted, sensing area 15 is designed to assure there is little or no back pressure within the yarn plug because of wall-plug friction fore and aft of the plug axis.

Back pressure due to lateral plug-wall friction is eliminated or at least minimized or greatly reduced because of the inherent lateral integrity of the plug as it forms at the crimp site and guiding area, the relative short length of guide walls 11, and the application of pressure to the plug only at the sides of the plug at the downstream ends of the shoes. In this respect, as previously discussed, the inner surface of shoes 16 when in the vertical position (FIG. 5) are spaced farther apart than are walls 11 of the guiding area. Further, the shoes are controlled so that the application of a range of pressure is such as will retain the lateral integrity of the plug, thus, it is theorized, retaining plug mass at the crimp site and in the guiding and sensing areas as the denier of the yarn along its length changes.

Figure 7:
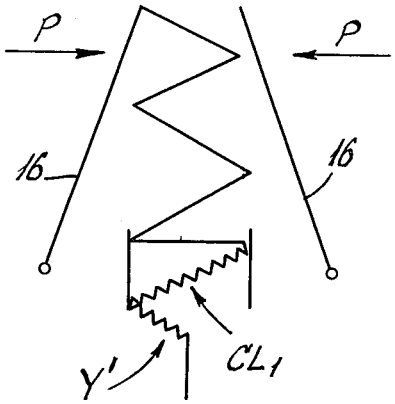
FIG. 7 is an exaggerated disgramatic view of yarn being crimped in a head incorporating the invention.
Figure 8:
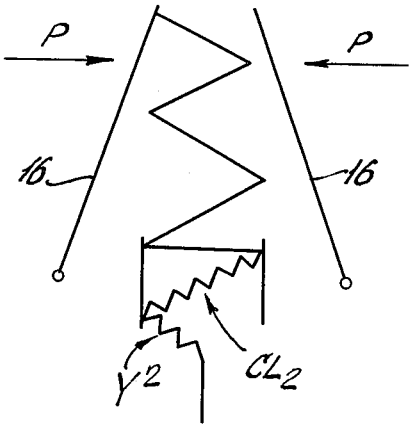
FIG. 8 is an exaggerated diagramatic view similar to FIG. 7.

As shown in the diagramatic views of FIGS. 7 and 8, yarn Y' of a relatively low denier is crimped in apparatus according to the invention. As the yarn plug forms in the crimping and guiding areas, it is crimped to a relatively high crimp level as at $CL_1$. As the denier changes along the length of the yarn to become higher as at Y2 in FIG. 8, the crimp level becomes lower as at $CL_2$. The pressure of shoes 16 against the sides of the plug remains constant and as the integrity of the side of the plug remains relatively constant, it is theorized that the mass of the plug and thus its impact characteristics at the crimping area remain the same resulting in the variation in crimp level, just discussed.

Experimentation with apparatus as disclosed herein establishes that at relatively high pressures (applied to the downstream ends of the shoes via cylinder 42) there is an inverse relationship between crimps per inch and denier. For example, ends of undrawn yarn which would result in drawn yarn of 2720 denier, 2100 denier, 1500 denier and 760 denier, respectively, were drawn and immediately fed on the run into the crimping head disclosed herein in which the downstream ends of the shoes were under 25 p.s.i. cylinder pressure (resulting in about 8 p.s.i. pressure in the sensing area). The crimp level of resulting respective yarn ends were 18.4 c.p.i., 20.1 c.p.i., 23 c.p.i. and 27.8 c.p.i. This trend indicated, because, it is theorized, of the sensitivity of the apparatus to change in the mass of the yarn plug, that the end product in any given instance would be more uniform. As drawn denier increased, the textured denier decreased. The opposite relationship between c.p.i. and denier results from prior art apparatus which attempt to impede the travel of the plug to create a uniform back pressure in the plug regardless of plug mass.

At relatively lower pressures the same relationship between c.p.i. and denier held true, but to a lesser extent. For example, undrawn yarn ends resulting in drawn yarn of 2500, 1840, 1280 and 720 denier, respectively, drawn and fed on the run to the disclosed head, coacting with the ends of the shoes under 15 p.s.i. cylinder pressure, resulted in crimp levels of 14.0, 13.6 14.5 and 16.7 c.p.i., respectively.

Importantly, the above noted variations in crimps per square inch in the textured yarn (between 18.4 and 27.8, and between 14.0 and 16.7) are less than experienced when processing any single yarn end in some prior art commercial stuffer box crimpers; the denier variation in undrawn yarn, along the length of available stock being ± 5%, whereas in the above noted experiments the denier varied from 500 denier to 2,000 from yarn end to yarn end.

What is claimed is:

1. A crimping head; including means for feeding a yarn end therein and for forming a plug of yarn therefrom, said head comprising a crimp site and plug guiding area of relatively short length defined in part by opposing surface means spaced apart a predetermined distance for contacting opposite sides of the plug for substantially establishing the lateral width of the plug and for guiding the plug downstream, pressure means mounted laterally outwardly of and extending downstream of the downstream end of said guiding area on either side thereof, means for moving the downstream ends of said pressure means inwardly for applying a uniform pressure on opposite sides of the plug adjacent said downstream ends only whereby back pressure in the plug due to lateral plug-surface friction between said guiding area and said downstream end of said pressure means is minimized or greatly reduced.

2. The crimping head of claim 1, including front and rear opposing surface means extending downstream between said guiding area and said downstream end of said pressure means and providing recessed means for relaxing the plug fore and aft between said guiding area and said downstream end of said pressure means, whereby back pressure due to plug-surface friction therebetween is minimized or greatly reduced.

3. The crimping head of claim 1 including a plug gathering area immediately downstream of said pressure means said gathering area comprising opposed surfaces diverging in the downstream direction of plug travel and constituting means for minimizing or greatly reducing back pressure in the plug due to plug-surface friction.

4. The crimping head of claim 3, in which said opposing surfaces of said gathering area are disposed fore and aft of the direction of plug travel.

5. The crimping head of claim 1, including a plug gathering area immediately downstream of said pressure means, said gathering area comprising opposed surfaces disposed outwardly of the direction of plug travel a distance greater than that of opposing surface means of said guiding area.

6. The crimping head of claim 1, wherein the distance between said downstream end of said pressure means and the downstream end of said guiding area is at least two times the length of said guiding area.

7. The crimping head of claim 1, wherein said opposing surface means of said guiding area comprise a pair of flat surfaces disposed for contacting the sides of the plug and a second pair of flat surfaces further defining said guiding area are provided for disposition fore and aft of the plug.

8. The crimping head of claim 1 wherein said pressure means comprises a pair of laterally inwardly facing flat surfaces connected with said means for moving the same from and to operative and inoperative positions, said moving means including means for mounting said pressure laterally outwardly of said opposing surfaces of said guiding area and for moving only the downstream ends of said laterally inwardly facing flat surfaces into pressure applying contact with the plug.

* * * * *

UNITED STATES PATENT AND TRADEMARK OFFICE

CERTIFICATE OF CORRECTION

PATENT NO. : 3,938,226

DATED : February 17, 1976

INVENTOR(S) : JOHN S. ROBERTS

It is certified that error appears in the above-identified patent and that said Letters Patent are hereby corrected as shown below:

Column 6, line 27 --means-- is inserted after "pressure".

Signed and Sealed this

Sixteenth Day of November 1976

[SEAL]

*Attest:*

RUTH C. MASON
*Attesting Officer*

C. MARSHALL DANN
*Commissioner of Patents and Trademarks*